US005806393A

United States Patent [19]

Saporiti

[11] Patent Number: 5,806,393

[45] Date of Patent: Sep. 15, 1998

[54] DEVICE FOR CUTTING MATERIALS, PARTICULARLY FABRICS, WITH A RESISTANCE WIRE FIXED WITH RIVETS

[76] Inventor: Giancarlo Saporiti, Piazza Risorgimento, 4, 21013 Gallarate (Varese), Italy

[21] Appl. No.: 609,637

[22] Filed: Mar. 1, 1996

[30] Foreign Application Priority Data

Mar. 3, 1995 [IT] Italy ..... MI950145 U

[51] Int. Cl.[6] ..... B26D 7/10

[52] U.S. Cl. ..... 83/171; 83/651.1; 83/698.11; 219/68

[58] Field of Search ..... 83/171, 651.1, 83/698.11, 698.71, 16; 219/68

[56] References Cited

U.S. PATENT DOCUMENTS

| | | | |
|---|---|---|---|
| 168,801 | 10/1875 | Stevens | 83/651.1 X |
| 1,155,835 | 10/1915 | Murphy | 83/171 |
| 3,017,487 | 1/1962 | Priestly | 83/171 |
| 3,096,582 | 7/1963 | Mueller | 83/651.1 |
| 3,159,124 | 12/1964 | Rubin | 83/171 X |
| 3,756,111 | 9/1973 | Weidenmiller | 83/651.1 |
| 3,901,110 | 8/1975 | Priestly | 83/171 |
| 4,301,702 | 11/1981 | Collier | 83/171 X |

*Primary Examiner*—Eugenia Jones

*Attorney, Agent, or Firm*—Finnegan, Henderson, Farabow, Garrett & Dunner, L.L.P.

[57] ABSTRACT

A device (10) for cutting a material into strips, particularly fabric ribbon flowing continuously along a plurality of such devices mounted on a bar positioned transverse to the direction of movement of the fabric, includes a body (12) coupled to the bar and two electrodes (20, 22) between which is stretched a resistance wire (28). The resistance wire is attached to the electrodes by rivets (30, 32).

7 Claims, 1 Drawing Sheet

DEVICE FOR CUTTING MATERIALS, PARTICULARLY FABRICS, WITH A RESISTANCE WIRE FIXED WITH RIVETS

BACKGROUND OF THE INVENTION

1. Field of Invention

The present invention relates to the field of cutting fabrics in a continuous movement, for example, cutting sheet material such as fabric ribbon.

2. Description of the Related Art

It is known in the art to cut continuously moving fabric ribbon into strips longitudinally by thermal cutting means, such as through the use of spaced resistance wires orientated transverse to the fabric. Such a thermal cutting device includes a body carrying two electrodes connected to an electrical power supply, and a cutting resistance wire stretching between the two electrodes. A plurality of such devices are located on a supporting bar positioned transverse to the direction of movement of the fabric, and the devices can be arranged at desired positions along the bar.

An example of such a thermal cutting device is described in applicant's Italian utility model application No. MI93U000960. The present invention can be applied not only to the device described in the utility model application, but also to various other devices.

The utility model application MI93U000960 does not specify how the resistance wire is mounted on the electrodes. A known method of mounting the resistance wires to the electrodes includes inserting the resistance wires in holes provided in the electrodes and winding the resistance wires around the heads of the electrodes. Another known method of mounting the resistance wires about the electrodes requires soldering the resistance wire to the ends of the two electrodes.

Such known methods of mounting the resistance wires to the electrodes have the following drawbacks. The soldering method requires time and a certain skill on the part of the operator. The winding method does not provide for a good tension of the resistance wires. As a result of the improper tension, a non-constant difference in voltage between the two electrodes heats adjacent resistance wires to a different magnitude, causing variable cutting of proximate edges. Further, such non-constant difference in voltage between the two electrodes may result in carbon residue remaining on the separated edges of the fabric after cutting or current leakage which could damage the plastic body of the device.

SUMMARY OF THE INVENTION

The aim of the present invention is to overcome the drawbacks associated with the prior art methods for mounting the resistance wires to the electrode ends.

This aim has been achieved with a device for cutting sheet material into strips including a resistance wire stretching between two electrodes, the electrodes being mounted on a body equipped with retaining elements for mounting on a bar, wherein the resistance wire is fixed to the electrodes by rivets.

The present invention makes it possible to achieve equal heating of adjacent devices on a single supporting bar. The present invention also permits higher manufacturing speeds and a greater consistency in the products manufactured. Further, the present invention reduces heat loss and hence maintains a longer life of the body of the device. Still further, the present invention reduces power consumption during operation.

BRIEF DESCRIPTION OF THE DRAWINGS

An embodiment of the invention will be described below by way of non-limiting example, with reference to the attached drawings in which.

DESCRIPTION OF THE PREFERRED EMBODIMENTS

Figure 1:
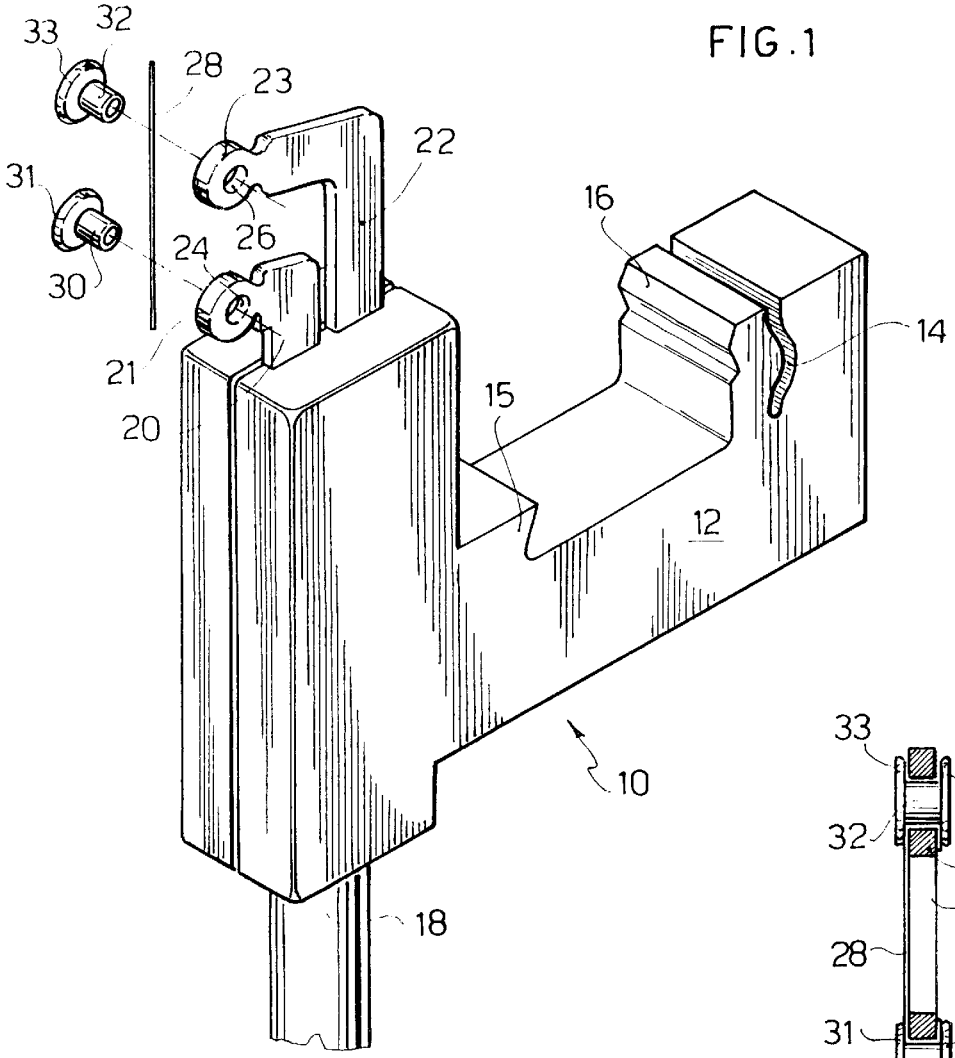
FIG. 1 is a perspective view of a device according to the present invention, illustrated in an exploded view before assembly.

The thermal cutting device according to the present invention is indicated as a whole with reference number 10. The thermal cutting device comprises a body 12 or support, the body or support including a cavity 14 and retaining elements 15 and 16 for assembly on a horizontal supporting bar (not illustrated). The retaining elements 15 and 16, and body 12 can preferably, but not necessarily, be made from a plastic material, as described in the Italian utility model mentioned above.

The body 12 of the thermal cutting device carries an electrical connection cable 18, and two metal electrodes 20, 22. The electrodes 20, 22 include heads, 21, 23 having through holes 24, 26. A resistance wire 28 is fixed to the heads 21, 23 by rivets 30, 32 which are inserted in the holes 24, 26. The rivets are then clinched on a side of the electrode heads 21, 23 opposite the side that accommodates the heads of the rivets 31, 33.

The mounting of the resistance wire to the thermal cutting device includes first inserting the resistance wire 28 into the holes 24, 26, so that the resistance wire 28 bridges the two electrodes. The resistance wire 28 is then pulled taut and cut leaving a generous length. The rivets 30, 32 are then inserted in the holes 24, 26 firmly fixing the resistance wire 28 in position. The rivets 30, 32 are then clinched at their ends opposite the rivet heads 31, 33. The portions of resistance wire 28 that extend from the clinched parts 35 and 37 of the rivets are then cut off.

In this way the mounting of the resistance wire 28 keeps the resistance wire 28 taut and firmly mounted between the electrodes, and provides for a thermal cutting device with constant heating characteristics.

Figure 2:
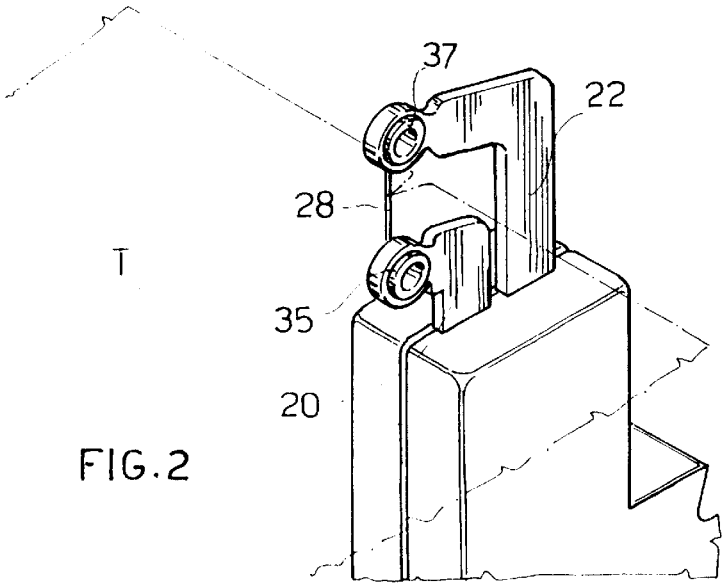
FIG. 2 is a perspective view, similar to FIG. 1, of the assembled device.
Figure 3:
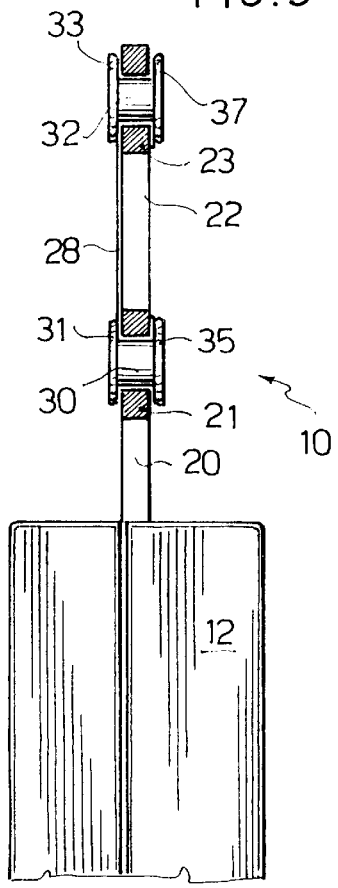
FIG. 3 is a section taken along line 3—3 of FIG. 2.

A fabric T in the cutting stage is shown with dashed and dotted lines in FIG. 2.

I claim:

1. A device for cutting sheet material into strips, comprising:

a body having a retaining means for mounting to a supporting bar;

a pair of electrodes mounted on the body, each electrode including a resistance wire hole; and a metal resistance wire stretching between the two electrodes and fixed to the electrodes through each resistance wire hole by rivets, each rivet including a rivet head and a rivet stem, said rivet stem being clinched so that the rivet head and a clinched part of the rivet are located on opposite sides of the electrode to fix the resistance wire to said electrodes.

2. A device according to claim 1, characterized in that the body is formed of an elastic material for detachably mounting the retaining means to the supporting bar.

3. A device according to claim 2, wherein the body includes a slit for increasing an elasticity of the body.

4. A device for cutting sheet material into strips, comprising:

a body;

a pair of electrodes mounted on the body, each electrode including a resistance wire hole; and a metal resistance wire stretching between the two electrodes and fixed to the electrodes through each resistance wire hole by rivets, each rivet including a rivet head and a rivet stem, said rivet stem being clinched so that the rivet head and a clinched part of the rivet are located on opposite sides of the electrode to fix the resistance wire about a line extending along an inner surface of the resistance wire hole.

5. A device according to claim 4, wherein the rivets also attach the resistance wire to the electrodes about an area adjacent the resistance wire hole on each side of each electrode.

6. A device according to claim 4, characterized in that the body is formed of an elastic material for detachably mounting the body to a supporting bar via a retaining means.

7. A device according to claim 6, wherein the body includes a slit for increasing an elasticity of the body.

* * * * *